US007395817B2

(12) United States Patent
Fujishiro et al.

(10) Patent No.: US 7,395,817 B2
(45) Date of Patent: Jul. 8, 2008

(54) EVAPORATED FUEL ADSORBING APPARATUS

(75) Inventors: Osamu Fujishiro, Nagoya (JP); Toshikazu Harada, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 11/727,862

(22) Filed: Mar. 28, 2007

(65) Prior Publication Data

US 2007/0227513 A1 Oct. 4, 2007

(30) Foreign Application Priority Data

Mar. 30, 2006 (JP) ..... 2006-094636

(51) Int. Cl.
*F02M 33/04* (2006.01)
*F02M 33/02* (2006.01)

(52) U.S. Cl. ..... 123/519; 123/572

(58) Field of Classification Search ..... 123/519, 123/516, 518, 520, 198 D, 572, 573
See application file for complete search history.

(56) References Cited

U.S. PATENT DOCUMENTS 3,678,663 A * 7/1972 Hansen ..... 96/141
6,637,415 B2 * 10/2003 Yoshioka et al. ..... 123/518
6,698,403 B2 * 3/2004 Honda et al. ..... 123/520
6,810,861 B2 * 11/2004 Itakura et al. ..... 123/516
7,182,802 B2 * 2/2007 Bause et al. ..... 95/146
2002/0059920 A1 * 5/2002 Yoshioka et al. ..... 123/518
2003/0116021 A1 * 6/2003 Oda et al. ..... 96/134
2004/0079344 A1 * 4/2004 Gimby et al. ..... 123/519
2004/0083894 A1 * 5/2004 Koyama et al. ..... 96/133

FOREIGN PATENT DOCUMENTS

JP A 11-82192 3/1999
JP 2001227421 * 8/2001
JP A 2001-234781 8/2001
JP A 2002-39025 2/2002
JP A 2003-214263 7/2003
JP A 2005-273528 10/2005

OTHER PUBLICATIONS

Yoshihiro et al., Abstract of JP-2001227421, filed Feb. 16, 2000, published Aug. 24, 2001,international classification F02M 33/00, F02M 25/08.*

* cited by examiner

*Primary Examiner*—Mahmoud Gimie
(74) *Attorney, Agent, or Firm*—Oliff & Berridge, PLC

(57) ABSTRACT

An evaporated fuel adsorbing apparatus includes a surge tank provided in an intake system for an internal combustion engine; a resonator connected with only the surge tank; and a fuel adsorbing member that adsorbs evaporated fuel. The fuel adsorbing member is provided in the resonator.

6 Claims, 2 Drawing Sheets

EVAPORATED FUEL ADSORBING APPARATUS

INCORPORATION BY REFERENCE

The disclosure of Japanese Patent Application No. 2006-094636 filed on Mar. 30, 2006, including the specification, drawings and abstract is incorporated herein by reference in its entirety.

BACKGROUND OF THE INVENTION

1. Field of the Invention

The invention relates to an evaporated fuel adsorbing apparatus for an internal combustion engine.

2. Description of the Related Art

In an internal combustion engine, fuel in cylinders may be evaporated and diffused in an intake passage after the engine stops. Thus, for example, Japanese Patent Application Publication No. 2002-39025 (JP-A-2002-39025) describes a technology in which a concave portion is formed in the inner wall of a surge tank that constitutes the intake passage of an internal combustion engine, and a fuel adsorbing member that adsorbs fuel is provided in the concave portion. With this configuration, the fuel adsorbing member adsorbs the evaporated fuel that remains in the intake passage. Therefore, it is possible to reduce the concentration of fuel in the intake passage.

In some internal combustion engines, a blow-by passage may be connected to the portion of the intake passage upstream of a throttle valve. Blow-by gas in a crankcase is introduced into the intake passage through the blow-by passage. Because the blow-by gas contains evaporated fuel and oil mist, the oil mist flows into the intake passage through the blow-by passage. Thus, in the technology described in Japanese Patent Application Publication No. 2002-39025, the fuel adsorbing member may adsorb the oil mist, and accordingly, the fuel adsorbing member may deteriorate, Japanese Patent Application Publication No. 2003-214263 (JP-A-2003-214263) describes a technology in which a fuel adsorbing member is provided in a resonator that is provided upstream of a throttle valve in an intake passage. With this configuration, because the fuel adsorbing member is provided in the resonator, the fuel adsorbing member is unlikely to contact the oil mist in the intake passage. However, with this configuration, because the fuel adsorbing member is provided upstream of the throttle valve in the intake passage, that is, the fuel adsorbing member is provided at a position far from the cylinders, it is not possible to suppress an increase in the concentration of fuel in the intake passage at a position near the cylinders, i.e., an increase in the concentration of fuel in an intake manifold or a surge tank. Therefore, when flame is generated during a combustion stroke, and the flame is not extinguished and remains until a next intake stroke, for example, at the time of cold start, it is not possible to sufficiently suppress the phenomenon that the flame in the cylinder flows back to the intake passage through an intake port, i.e., so-called back fire. This back fire may decrease the durability of an intake pipe.

SUMMARY OF THE INVENTION

A first aspect of the invention relates to an evaporated fuel adsorbing apparatus that includes a surge tank provided in an intake system for an internal combustion engine; a resonator connected with only the surge tank; and a fuel adsorbing member that adsorbs evaporated fuel. The fuel adsorbing member is provided in the resonator.

According to the first aspect, the fuel adsorbing member is provided in the resonator connected with only the surge tank. Therefore, the fuel adsorbing member is unlikely to be directly exposed to the intake air that contains oil mist. As a result, it is possible to suppress the deterioration of the fuel adsorbing member due to oil, without adding any special configuration for suppressing the adhesion of oil Also, because the fuel adsorbing member is provided in the resonator connected with only the surge tank, it is possible to suppress an increase in the concentration of fuel in the intake passage at a position near the cylinder. As a result, it is possible to suppress occurrence of back fire.

BRIEF DESCRIPTION OF THE DRAWINGS

The foregoing and/or further objects, features and advantages of the invention will become apparent from the following description of example embodiments with reference to the accompanying drawings, in which the same or corresponding portions will be denoted by the same reference numerals and wherein.

DETAILED DESCRIPTION OF THE EXAMPLE EMBODIMENTS

An evaporated fuel adsorbing apparatus according to an embodiment of the invention will be described with reference to FIG. 1. The evaporated fuel adsorbing apparatus according to the embodiment is applied to an in-line four-cylinder internal combustion engine.

Figure 1:
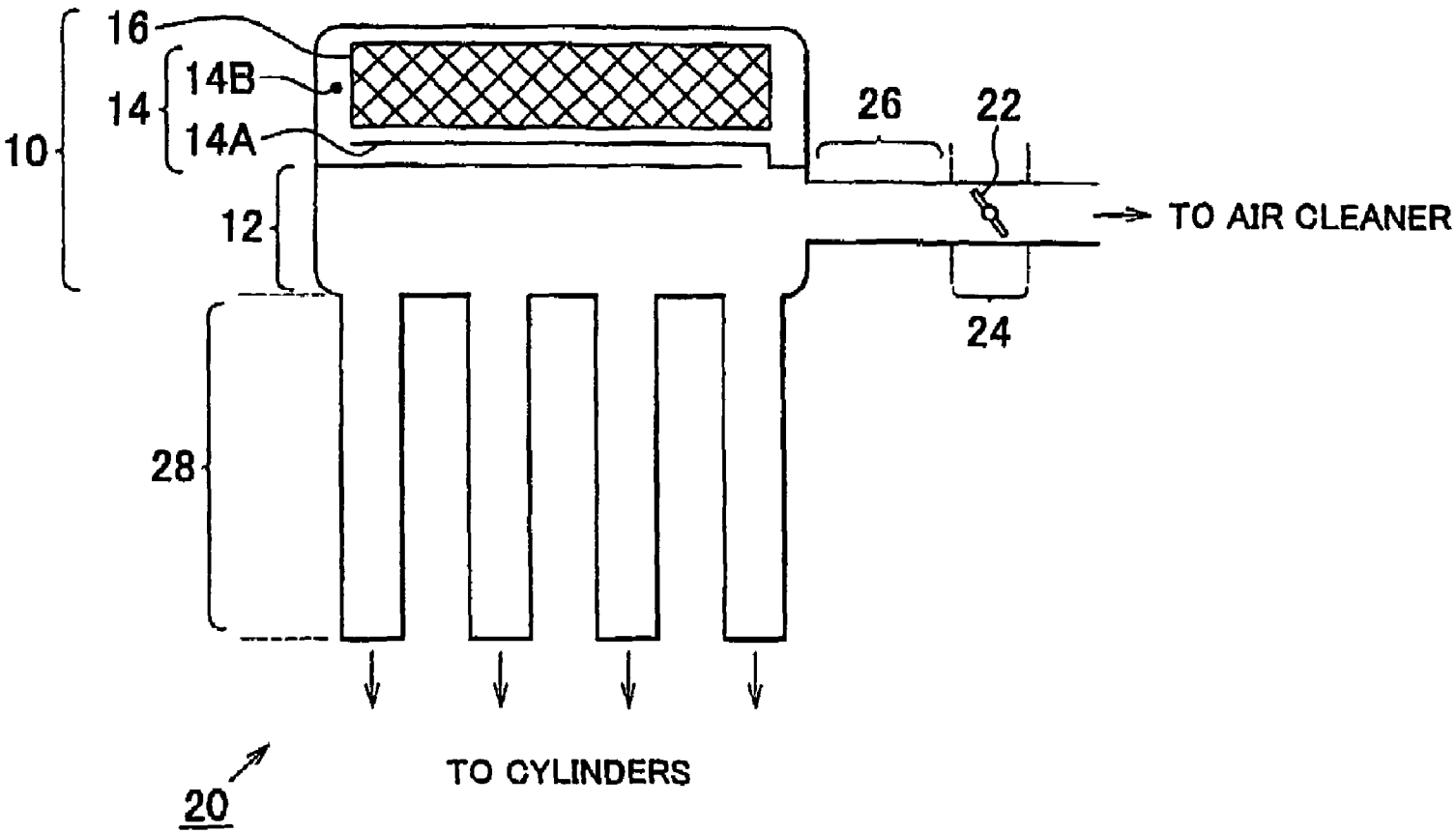
FIG. 1 is a partial cross sectional view showing an intake passage that constitutes an evaporate fuel adsorbing apparatus according to an embodiment of the invention.

FIG. 1 is a partial cross sectional view showing an intake passage that constitutes the evaporated fuel adsorbing apparatus according to the embodiment. In the intake passage 20, a throttle body 24 is provided downstream of an air cleaner (not shown) in the direction in which intake air flows (hereinafter, referred to as "intake-air flow direction). A throttle valve 22 is provided in the throttle body 24. A blow-by passage is connected to the portion of the intake passage 20 upstream of the throttle valve 22 in the intake-air flow direction. Blow-by gas in a crankcase is introduced to the intake passage 20 through the blow-by passage. The blow-by passage has been described above.

A surge tank 12 is connected to the portion of the intake passage 20 downstream of the throttle body 24 in the intake-air flow direction, via an intake pipe 26. Intake air is introduced into the surge tank 12. Thus, the surge tank 12 has the function of suppressing the pulsations of intake air, and interference of intake air.

A resonator 14 is connected with the surge tank 12. The resonator 14 includes a communication pipe 14A and an air chamber 14B. One end of the communication pipe 14A is communicated with the surge tank 12. The other end of the communication pipe 14A is communicated with the air chamber 14B. Thus, the resonator 14 is connected with only the surge tank 12. The resonator 14 has the function of smoothing a change in engine torque by adjusting the relation between the rotational speed of the internal combustion engine and intake-air charging efficiency, using the resonance effect of intake air. Considering the function of the resonator 14, the portion that has a large flow passage area (i.e., the air chamber 14B) is connected with the surge tank 12 through the portion that has a small flow passage area (i.e., the communication pipe 14A).

In the intake passage 20, an intake manifold 28 is provided downstream of the surge tank 12 in the intake-air flow direction. The intake air introduced into the surge tank 12 is distributed to cylinders through branch pipes of the intake manifold 28. In general, the surge tank 12 is connected to the portion near the cylinders, such as the intake manifold 28.

On the inner peripheral surface of the air chamber 14B of the resonator 14, fuel adsorbing members 16 having a uniform thickness are provided to face each other (only one of the adsorbing members 16 is shown in FIG. 1). The fuel adsorbing member 16 has the function of adsorbing evaporated fuel in the resonator 14. In this embodiment, each fuel adsorbing member 16 is in the form of a sheet. As the material used to form the fuel adsorbing member 16, activated carbon is employed.

In this embodiment, the surge tank 12, the resonator 14, and the intake manifold 28 are made of resin. After the fuel adsorbing members 16 are provided in the resonator 14, the surge tank 12 and the resonator 14 are integrated with each other. When the surge tank 12 and the resonator 14 are integrated with each other, the communication pipe 14A is formed at the border between the surge tank 12 and the resonator 14.

In the embodiment that has been described, the following effects can be obtained. The fuel adsorbing members 16 are provided in the resonator 14 connected with only the surge tank 12. Therefore, the fuel adsorbing members 16 are unlikely to be exposed to the intake air that contains oil mist. As a result, it is possible to suppress the deterioration of the fuel adsorbing members 16 due to oil, without adding any special configuration for suppressing the adhesion of oil.

Also, the fuel adsorbing members 16 are provided in the resonator 14 connected with only the surge tank 12, that is, the fuel adsorbing members 16 are provided at a position near the cylinders. Therefore, it is possible to suppress an increase in the concentration of fuel in the intake passage 20 at the position near the cylinders. As a result, it is possible to suppress occurrence of back fire.

Also, because the resonator 14 and the surge tank 12 are integrally formed, the configuration of the evaporated fuel adsorbing apparatus 10 can be further simplified.

The above-described embodiment may be modified as follows.

In the above-described embodiment, as the material used to form the fuel adsorbing members 16, the activated carbon is employed. However, the material used to form the fuel adsorbing members 16 is not limited to the activated carbon. Any material that adsorbs evaporated fuel may be employed.

In the above-described embodiment, the fuel adsorbing members 16 having a uniform thickness are provided to face each other on the inner peripheral surface of the air chamber 14B of the resonator 14. However, a fuel adsorbing member having a uniform thickness is provided on the entire inner peripheral surface of the resonator 14. With this configuration, it is possible to further improve the performance of the fuel adsorbing member, without deteriorating the original function of the resonator 14.

Because the fuel adsorbing member(s) is (are) uniformly provided on the inner peripheral surface of the resonator 14, the provision of the fuel adsorbing member(s) 16 does not impair the original function of the resonator 14, that is, the function of smoothing the change in the engine torque by adjusting the relation between the rotational speed of the internal combustion engine and the intake-air charging efficiency.

Figure 2:
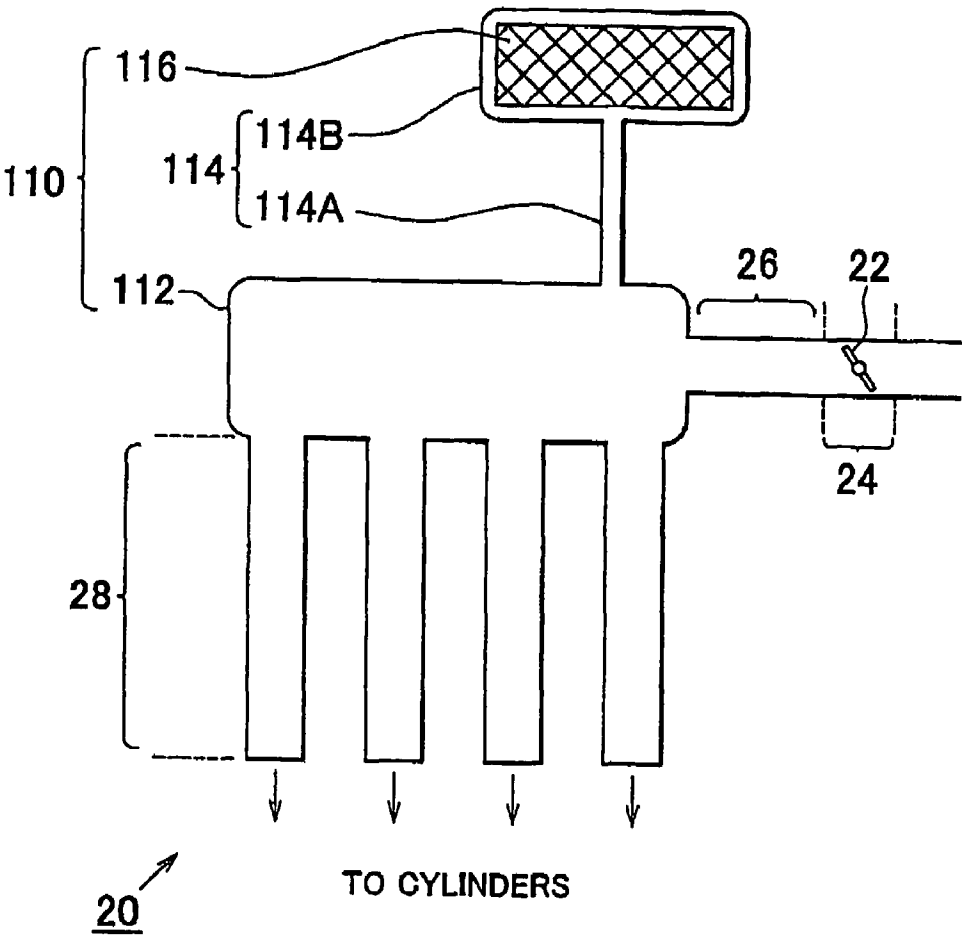
FIG. 2 is a partial cross sectional view showing a modified example of the intake passage that constitutes the evaporated fuel adsorbing apparatus according to the embodiment of the invention.

In the above-described embodiment, the resonator 14 and the surge tank 12 are integrally formed. However, the resonator 14 and the surge tank 12 need not necessarily be integrally formed. The resonator 14 and the surge tank 12 may be formed as separate components. For example, as shown in FIG. 2, a communication pipe 114A and an air chamber 114B, which constitute a resonator 114, may be integrally formed, and the resonator 114 may be fitted to a surge tank 112. In this case as well, the surge tank 112, the resonator 114, and the fuel adsorbing member(s) 116 constitute the evaporated fuel adsorbing apparatus. In other words, the invention is applied to any evaporated fuel adsorbing apparatus in which the fuel adsorbing member(s) is (are) provided in the resonator connected with only the surge tank.

What is claimed is:

1. An evaporated fuel adsorbing apparatus comprising:

a surge tank provided in an intake system for an internal combustion engine;

a resonator located downstream of a throttle valve and connected with only the surge tank; and a fuel adsorbing member that adsorbs evaporated fuel, wherein the fuel adsorbing member is provided in the resonator.

2. The evaporated fuel adsorbing apparatus according to claim 1, wherein the resonator is formed integrally with the surge tank.

3. The evaporated fuel adsorbing apparatus according to claim 1, wherein the fuel adsorbing member is provided on an inner peripheral surface of the resonator.

4. The evaporated fuel adsorbing apparatus according to claim 3, wherein the fuel adsorbing member is uniformly provided on an entire inner peripheral surface of the resonator.

5. The evaporated fuel adsorbing apparatus according to claim 3, wherein the fuel adsorbing member is provided in plurality, and the fuel adsorbing members face each other.

6. The evaporated fuel adsorbing apparatus according to claim 3, wherein the fuel adsorbing member has a uniform thickness.

* * * * *

UNITED STATES PATENT AND TRADEMARK OFFICE

CERTIFICATE OF CORRECTION

PATENT NO. : 7,395,817 B2
APPLICATION NO. : 11/727862
DATED : July 8, 2008
INVENTOR(S) : Osamu Fujishiro and Toshikazu Harada It is certified that error appears in the above-identified patent and that said Letters Patent is hereby corrected as shown below:

Title Page, Item (73) should read:

(73) Assignee: Nippon Soken, Inc.
Nishio (JP)

Toyota Jidosha Kabushiki Kaisha
Toyota (JP)

Signed and Sealed this

Eighteenth Day of August, 2009

David J. Kappos

David J. Kappos
*Director of the United States Patent and Trademark Office*